US007649514B2

(12) United States Patent
Choi et al.

(10) Patent No.: US 7,649,514 B2
(45) Date of Patent: Jan. 19, 2010

(54) DATA DRIVING CIRCUIT, ORGANIC LIGHT EMITTING DIODE (OLED) DISPLAY USING THE DATA DRIVING CIRCUIT, AND METHOD OF DRIVING THE OLED DISPLAY

(75) Inventors: Sang-Moo Choi, Kyunggi-do (KR); Hong-Kwon Kim, Kyunggi-do (KR); Oh-Kyong Kwon, Seoul (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 746 days.

(21) Appl. No.: 11/313,784

(22) Filed: Dec. 22, 2005

(65) Prior Publication Data

US 2006/0139261 A1 Jun. 29, 2006

(30) Foreign Application Priority Data

Dec. 24, 2004 (KR) ..... 10-2004-0112532

(51) Int. Cl.
*G09G 3/30* (2006.01)

(52) U.S. Cl. ..... 345/78; 345/204

(58) Field of Classification Search ..... 345/76, 345/77, 78, 204, 205, 206, 208, 690
See application file for complete search history.

(56) References Cited

U.S. PATENT DOCUMENTS 6,777,885 B2 * 8/2004 Koyama ..... 315/169.1
6,806,497 B2 * 10/2004 Jo ..... 257/59
7,027,014 B2 * 4/2006 Sato et al. ..... 345/76
7,071,905 B1 * 7/2006 Fan ..... 345/76
7,304,621 B2 * 12/2007 Oomori et al. ..... 345/82
7,432,891 B2 * 10/2008 Fruehauf ..... 345/82

(Continued)

FOREIGN PATENT DOCUMENTS

CN 1353410 6/2002

(Continued)

OTHER PUBLICATIONS

Office action from the Patent Office of Japan issued in Applicant's corresponding Japanese Patent Application No. 2005-138549 dated Nov. 25, 2008.

(Continued)

*Primary Examiner*—Richard Hjerpe
*Assistant Examiner*—Tom V Sheng
(74) *Attorney, Agent, or Firm*—Robert E. Bushnell, Esq.

(57) ABSTRACT

A data driving circuit including: a voltage digital-analog converter adapted to generate a first gradation voltage corresponding to external data; a current digital-analog converter adapted to generate a gradation current corresponding to the external data; a voltage control unit adapted to receive a feedback pixel current from a pixel via a data line and to generate a second gradation voltage by increasing or decreasing a level of the first gradation voltage in accordance with the feedback pixel current; a buffer unit adapted to selectively supply the first or second gradation voltage to the data line; and a selection unit adapted to selectively connect the data line to either the buffer unit or the voltage control unit. With this configuration, an image is displayed with a desired brightness.

40 Claims, 8 Drawing Sheets

U.S. PATENT DOCUMENTS

| | | | | |
|---|---|---|---|---|
| 7,456,812 | B2 * | 11/2008 | Smith et al. | 345/82 |
| 2002/0089357 | A1 | 7/2002 | Pae et al. | |
| 2003/0016201 | A1 | 1/2003 | Ayres et al. | |
| 2004/0100430 | A1 | 5/2004 | Fruehauf | |
| 2004/0207579 | A1 * | 10/2004 | Matsumoto | 345/76 |
| 2005/0285822 | A1 * | 12/2005 | Reddy et al. | 345/76 |
| 2006/0038758 | A1 * | 2/2006 | Routley et al. | 345/81 |
| 2006/0066622 | A1 * | 3/2006 | Steer | 345/504 |
| 2007/0080908 | A1 * | 4/2007 | Nathan et al. | 345/77 |

FOREIGN PATENT DOCUMENTS

| | | |
|---|---|---|
| CN | 1531383 | 9/2004 |
| EP | 0378249 | 7/1990 |
| JP | 2004-004675 | 1/2004 |
| KR | 1020020069563 | 9/2002 |
| KR | 1020040076972 | 9/2004 |
| WO | WO 03/107313 | 12/2003 |

OTHER PUBLICATIONS

*Office action* from the Patent Office of the P.R. of China issued in Applicant's corresponding Chinese Patent Application No. 200510121671.4 datedMar. 14, 2008.

Patent Gazette from the Chinese Patent Office issued in Applicant's corresponding Chinese Patent Application No. 200510121671.4 dated Mar. 11, 2009.

* cited by examiner

DATA DRIVING CIRCUIT, ORGANIC LIGHT EMITTING DIODE (OLED) DISPLAY USING THE DATA DRIVING CIRCUIT, AND METHOD OF DRIVING THE OLED DISPLAY

CLAIM OF PRIORITY

This application makes reference to, incorporates the same herin, and claims all benefits accruing under 35 U.S.C. §119 from an application earlier filed in the Korean Intellectual Property Office on Dec. 24, 2004 and there duly assigned Serial No. 2004-112532.

BACKGROUND OF THE INVENTION

1. Field of the Invention

The present invention relates to a data driving circuit, an Organic Light Emitting Diode (OLED) display using the data driving circuit, and a method of driving the OLED display, and more particularly, to a data driving circuit to display an image with a desired brightness, an OLED display using the data driving circuit, and a method of driving the OLED display.

2. Description of the Related Art

Various flat panel displays have recently been developed as alternatives to a relatively heavy and bulky Cathode Ray Tube (CRT) display. The flat panel display includes a Liquid Crystal Display (LCD), a Field Emission Display (FED), a Plasma Display Panel (PDP), an Organic Light Emitting Diode Display (OLED), etc.

Among the flat panel displays, the OLED display can emit light for itself by electron-hole recombination. Such an OLED display has advantages in that its response time is relatively fast and its power consumption is relatively low. Generally, the OLED display employs a transistor provided in each pixel for supplying a current corresponding to a data signal to a light emitting device, thereby allowing the light emitting device to emit light.

An OLED display comprises: a pixel portion including a plurality of pixels formed in a region defined by the intersection of scan lines and data lines; a scan driver to drive the scan lines; a data driver to drive the data lines; and a timing controller to control the scan driver and the data driver.

The timing controller generates a Data Control Signal (DCS) and a Scan Control Signal (SCS) corresponding to an external synchronization signal. The DCS and the SCS are supplied from the timing controller to the data driver and the scan driver, respectively. Furthermore, the timing controller supplies external data to the data driver.

The scan driver receives the SCS from the timing controller. The scan driver generates scan signals on the basis of the SCS and supplies the scan signals to the scan lines.

The data driver receives the DCS from the timing controller. The data driver generates data signals on the basis of the DCS and supplies the data signals to the data lines while synchronizing with the scan signals.

The display portion receives first and second voltages from an external power source, and supplies them to the respective pixels. When the first voltage and the second voltage are supplied to the pixels, each pixel controls a current corresponding to the data signal to flow from a first voltage line to a second voltage line via the light emitting device, thereby emitting light corresponding to the data signal.

That is, in this OLED display, each pixel emits light with a predetermined brightness corresponding to the data signal, but cannot emit light with the desired brightness because transistors provided in the respective pixels have different threshold voltages. Furthermore, in this OLED display, there is no method of measuring and controlling a real current flowing in each pixel in correspondence to the data signal.

SUMMARY OF THE INVENTION

Accordingly, it is an object of the present invention to provide a data driving circuit to display an image with desired brightness, an Organic Light Emitting Diode (OLED) display using the data driving circuit, and a method of driving the OLED display.

The foregoing and/or other objects of the present invention are achieved by providing a data driving circuit comprising: a voltage digital-analog converter adapted to generate a first gradation voltage corresponding to external data; a current digital-analog converter adapted to generate a gradation current corresponding to the external data; a voltage control unit adapted to receive a feedback pixel current from a pixel via a data line and to generate a second gradation voltage by increasing or decreasing a level of the first gradation voltage in accordance with the feedback pixel current; a buffer unit adapted to selectively supply the first or second gradation voltage to the data line; and a selection unit adapted to selectively connect the data line to either the buffer unit or the voltage control unit.

The selection unit is adapted to preferably connect the data line to the buffer unit for a first period of one horizontal period, and is adapted to preferably alternately connect the data line to either the buffer unit or the voltage control unit for a second period of one horizontal period excluding the first period.

The selection unit comprises a plurality of selectors, each selector preferably comprising: a first transistor connected between the buffer unit and the data line; and a second transistor connected between the data line and the voltage control unit.

The first transistor is adapted to preferably be turned on for the first period, and the first and second transistors are adapted to preferably be alternately turned on and off for the second period.

The first gradation voltage is adapted to preferably be supplied to the pixel for the first period, and the second gradation voltage is adapted to preferably be supplied to the pixel upon the first transistor being turned on for the second period.

The pixel current is adapted to preferably be supplied from the data line to the voltage control unit upon the second transistor being turned on for the second period.

The voltage control unit comprises a plurality of voltage controllers, each voltage controller preferably comprising: a switching device connected between the voltage digital-analog converter and the buffer unit; a comparator adapted to preferably compare the gradation current with the pixel current; a capacitor having a first terminal connected to a common node between the switching device and the buffer unit; a voltage adjuster connected to a second terminal of the capacitor and adapted to preferably be controlled by the comparator to increase and decrease the voltage supplied to the second terminal of the capacitor; and a controller adapted to preferably control the switching device.

The controller is adapted to preferably turn on the switching device for the first period, and to preferably turn off the switching device for the second period.

The comparator is adapted to preferably generate a first control signal upon the gradation current being higher than the pixel current, and is adapted to preferably generate a second control signal upon the gradation current being lower than the pixel current.

The voltage adjuster is adapted to preferably selectively increase or decrease the voltage supplied to the capacitor on the basis of the first and second control signals to equalize the pixel current with the gradation current.

The controller is adapted to preferably output a counting signal, gradually increased for the second period, to the voltage adjuster.

An adjustable level of the voltage adjusted by the voltage adjuster is adapted to preferably correspond to the counting signal.

The adjustable level of the voltage adjusted by the voltage adjuster is adapted to preferably decrease in proportion as the counting signal increases.

The adjustable level of the voltage adjusted by the voltage adjuster is adapted to preferably decrease by half whenever the counting signal increases.

The controller is adapted to preferably receive a reset signal each horizontal period and to initialize the counting signal.

The reset signal preferably includes either a horizontal synchronous signal or a scan signal supplied to the pixel each horizontal period.

The data driving circuit preferably further comprises: a shift register adapted to preferably generate sampling signals in sequence; and a latch adapted to preferably store the data corresponding to the sampling signals, and to preferably supply the stored data to the voltage digital-analog converter and the current digital-analog converter.

The latch preferably comprises: a sampling latch adapted to preferably sequentially store the data corresponding to the sampling signal; a holding latch adapted to preferably store the data stored in the sampling latch and to preferably supply the stored data to the voltage digital-analog converter and the current digital-analog converter.

The data driving circuit preferably further comprises a level shifter adapted to preferably increase a voltage of the data stored in the holding latch and to supply the increased data to the voltage digital-analog converter and the current digital-analog converter.

The foregoing and/or other objects of the present invention are also achieved by providing an Organic Light Emitting Diode (OLED) display comprising: a plurality of first and second scan lines; a plurality of data lines intersecting the first and second scan lines; a pixel portion including a plurality of pixels connected to the first and second scan lines and the data line; a scan driver adapted to respectively supply first and second scan signals to the first and second scan lines; and a data driver connected to the data line and adapted to supply a first gradation voltage as a data signal to the data line; wherein the data driver is adapted to receive a feedback pixel current from each pixel via the data line, to generate a second gradation voltage by selectively increasing or decreasing a level of the first gradation voltage in accordance with the feedback pixel current, and to supply the second gradation voltage to the pixel.

Each pixel preferably comprises: a light emitting device; a driver adapted to preferably generate the pixel current corresponding to either the first or second voltage; a first transistor connected between the driver and the data line, and adapted to preferably be controlled by a first scan signal supplied via the first scan line; and a second transistor connected between the data line and a common node between the driver and the light emitting device, and adapted to preferably be controlled by a second scan signal supplied via the second scan line.

The first transistor is adapted to preferably be turned on in correspondence with the first scan signal for a first period of one horizontal period, and is adapted to preferably be turned on and off at least one time for a second period of the horizontal period excluding the first period.

The second transistor is adapted to preferably be turned off in correspondence with the second scan signal for the first period, and is adapted to preferably be turned on and off alternately with the first transistor for the second period.

The OLED display preferably further comprises a third transistor connected between the driver and the light emitting device, and adapted to preferably be turned off for a predetermined period upon the first scan signal being supplied to the first transistor and adapted to preferably be turned on for the other period in correspondence with an emission control signal supplied via an emission control line.

The data driver comprises at least one data driving circuit, the data driving circuit preferably comprising: a shift register adapted to preferably generate sampling signals in sequence; a latch adapted to preferably store external data corresponding to the sampling signal; a voltage digital-analog converter adapted to preferably generate the first gradation voltage corresponding to the data stored in the latch; a current digital-analog converter adapted to preferably generate a gradation current corresponding to the data stored in the latch part; a voltage control unit adapted to preferably generate the second gradation voltage corresponding to the pixel current supplied through the data line; a buffer unit adapted to preferably selectively supply either the first gradation voltage or the second gradation voltage to the data line; and a selection unit adapted to preferably selectively connect the data line to either the buffer unit or the voltage control unit.

The selection unit is adapted to preferably connect the data line to the buffer unit for the first period, and is adapted to preferably alternately connect the data line between the buffer unit and the voltage control unit for the second period.

The selection unit comprises a plurality of selectors, each selector preferably comprising: a third transistor connected between the buffer unit and the data line, and adapted to preferably be turned on and off in accordance with the first transistor receiving the first scan signal; and a fourth transistor connected between the data line and the voltage control unit and adapted to preferably be turned on and off in accordance with the second transistor receiving the second scan signal.

The first gradation voltage or the second gradation voltage is adapted to preferably be supplied from the buffer unit to the pixel via the data line upon the third transistor being turned on, and the pixel current is adapted to preferably be supplied to the voltage control unit via the data line upon the fourth transistor being turned on.

The voltage control unit comprises a plurality of voltage controllers, each voltage controller preferably comprising: a switching device connected between the voltage digital-analog converter and the buffer unit; a comparator adapted to preferably compare the gradation current with the pixel current; a capacitor having a first terminal connected to a common node between the switching device and the buffer unit; a voltage adjuster connected to a second terminal of the capacitor and adapted to be preferably controlled by the comparator to selectively increase and decrease the voltage supplied to the second terminal of the capacitor; and a controller adapted to preferably control the switching device.

The controller is adapted to preferably turn on the switching device for the first period, and is adapted to preferably turn off the switching device for the second period.

The voltage adjuster is adapted to preferably selectively increase or decrease the voltage supplied to the capacitor on the basis of compared results of the comparator to equalize the pixel current with the gradation current.

The controller is adapted to preferably output a counting signal, gradually increased for the second period, to the voltage adjuster.

The adjustable level of the voltage adjusted by the voltage adjuster is adapted to preferably decrease in proportion as the counting signal increases.

The adjustable level of the voltage adjusted by the voltage adjuster is adapted to preferably decrease by half whenever the counting signal increases.

The foregoing and/or other objects of the present invention are further achieved by providing a method of driving an Organic Light Emitting Diode (OLED) display, comprising: generating a first gradation voltage and a gradation current corresponding to data; supplying a first gradation voltage to the pixel via the data line; generating a pixel current with the pixel corresponding to the first gradation voltage; supplying the pixel current to the data driver via the data line; and comparing the gradation current with the pixel current with the data driver, and generating a second gradation voltage by increasing or decreasing a level of the first gradation voltage on the basis of the compared result.

The method preferably further comprises supplying the first gradation voltage to the pixel for a first period of one horizontal period.

The method preferably further comprises: generating the second gradation voltage by increasing or decreasing the level of the first gradation voltage on the basis of the compared result to cause the pixel current be equal to the gradation current; and supplying the second gradation voltage to the pixel via the data line.

The method preferably further comprises repeating supplying the pixel current to the data driver via the data line; and comparing the gradation current with the pixel current with the data driver, and generating a second gradation voltage by increasing or decreasing a level of the first gradation voltage on the basis of the compared result at least one time for a second period of one horizontal period excluding the first period.

The method preferably further comprises: generating a counting signal, gradually increased for the second period; and controlling an adjustable level of the first gradation voltage in accordance with the counting signal.

The method preferably further comprises decreasing the adjustable level of the first gradation voltage in proportion as the counting signal increases.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF INVENTION

Figure 1:
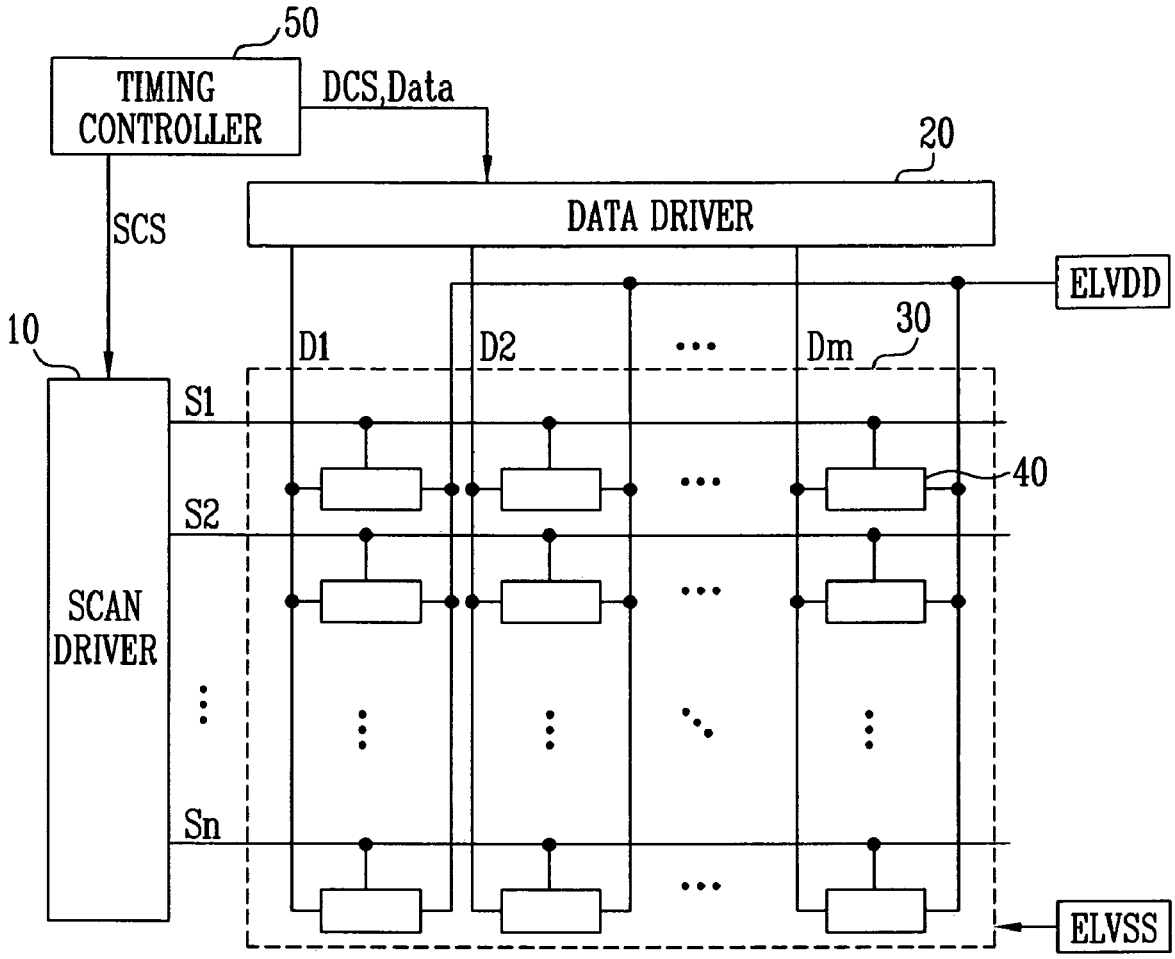
FIG. 1 is a view of an Organic Light Emitting Diode (OLED) display.

FIG. 1 is a view of an OLED display. Referring to FIG. 1, an OLED display comprises: a pixel portion 30 including a plurality of pixels 40 formed in a region defined by the intersection of scan lines S1 through Sn and data lines D1 through Dm; a scan driver 10 to drive the scan lines S1 through Sn; a data driver 20 to drive the data lines D1 through Dm; and a timing controller 50 to control the scan driver 10 and the data driver 20.

The timing controller 50 generates a Data Control Signal (DCS) and a Scan Control Signal (SCS) corresponding to an external synchronization signal. The DCS and the SCS are supplied from the timing controller 50 to the data driver 20 and the scan driver 10, respectively. Furthermore, the timing controller 50 supplies external data to the data driver 20.

The scan driver 10 receives the SCS from the timing controller 50. The scan driver 10 generates scan signals on the basis of the SCS and supplies the scan signals to the scan lines S1 through Sn.

The data driver 20 receives the DCS from the timing controller 50. The data driver 20 generates data signals on the basis of the DCS and supplies the data signals to the data lines D1 through Dm while synchronizing with the scan signals.

The display portion 30 receives first and second voltages ELVDD and ELVSS from an external power source, and supplies them to the respective pixels 40. When the first voltage ELVDD and the second voltage ELVSS are supplied to the pixels 40, each pixel 40 controls a current corresponding to the data signal to flow from a first voltage line ELVDD to a second voltage line ELVSS via the light emitting device, thereby emitting light corresponding to the data signal.

That is, in this OLED display, each pixel 40 emits light with a predetermined brightness corresponding to the data signal, but cannot emit light with the desired brightness because transistors provided in the respective pixels 40 have different threshold voltages. Furthermore, in this OLED display, there is no method of measuring and controlling a real current flowing in each pixel 40 in correspondence to the data signal.

Hereinafter, exemplary embodiments according to the present invention will be described with reference to the accompanying drawings, wherein the exemplary embodiments of the present invention are provided to be readily understood by those skilled in the art.

Figure 2:
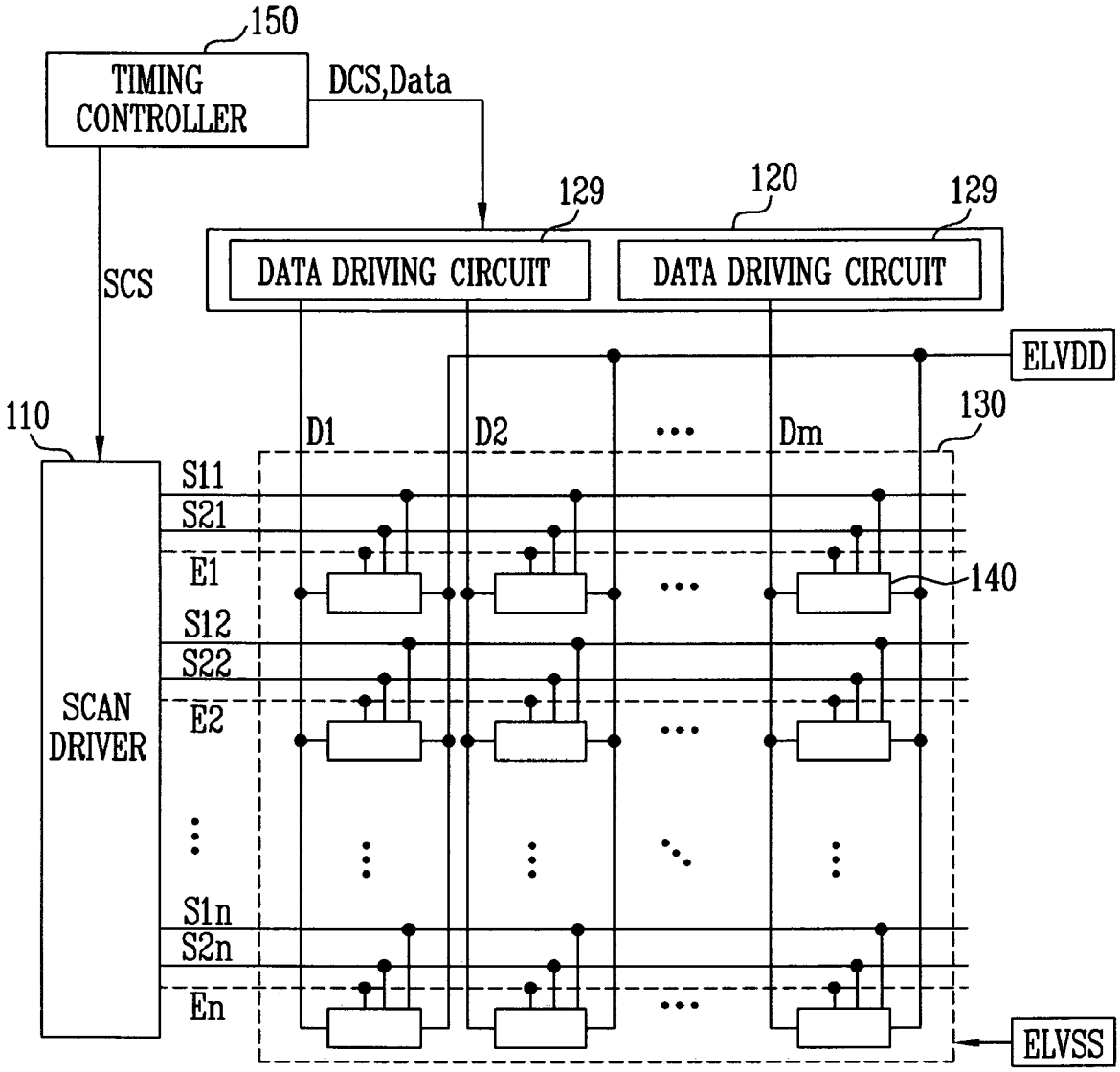
FIG. 2 is a view of an OLED display according to an embodiment of the present invention.

FIG. 2 illustrates an OLED display according to an embodiment of the present invention.

Referring to FIG. 2, an OLED display according to an embodiment of the present invention comprises: a pixel portion including a plurality of pixels 140 formed in regions defined by first scan lines S11 through S1*n*, second scan lines S21 through S2*n*, emission control lines E1 through En, and data lines D1 through Dm; a scan driver 110 to drive the first scan lines S11 through S1*n*, the second scan lines S21 through S2*n*, and the emission control lines E1 through En; a data driver to drive the data lines D1 through Dm; and a timing controller 150 to control the scan driver 110 and the data driver 120.

Figure 3:
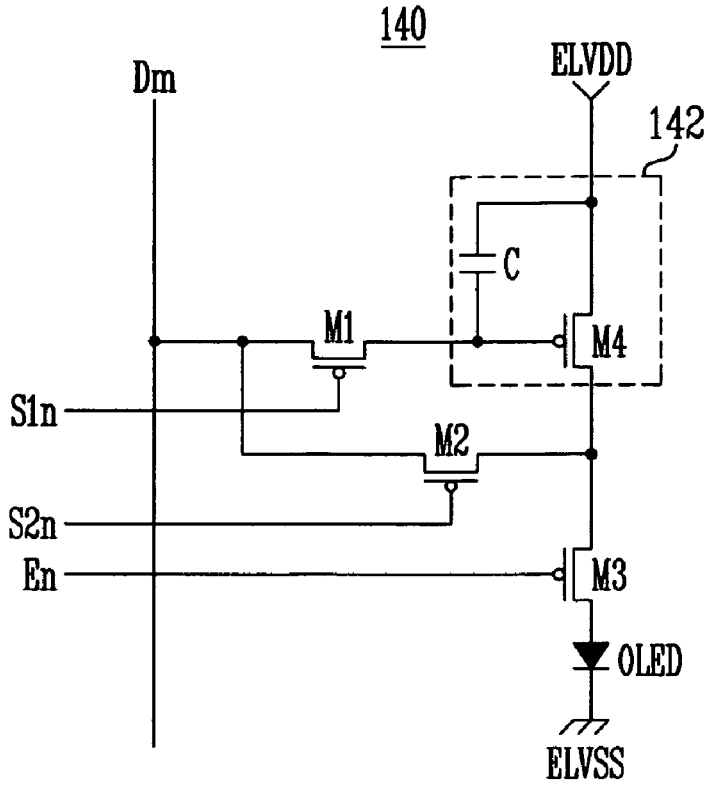
FIG. 3 is a circuit diagram of a pixel of FIG. 2.

The pixel portion 130 includes the plurality of pixels 140 formed in regions defined by the first scan lines S11 through S1*n*, the second scan lines S21 through S2*n*, the emission control lines E1 through En, and the data lines D1 through Dm. The pixels 140 receive external first and second voltages ELVDD and ELVSS. When the first voltage ELVDD and the second voltage ELVSS are supplied to the pixels 140, each pixel 140 controls a pixel current to flow from the first voltage line ELVDD to the second voltage line ELVSS via a light emitting device in correspondence with a data signal transmitted via the data line D. Furthermore, the pixel 140 supplies the pixel current to the data driver 120 via the data line D for a partial horizontal period. Thus, each pixel 140 is configured as shown in FIG. 3, which will be described later.

The timing controller 150 generates a DCS and an SCS in response to external synchronization signals. The timing controller 150 supplies the DCS and the SCS to the data driver 120 and the scan driver 110, respectively. Furthermore, the timing controller 150 supplies external data Data to the data driver 120.

The scan driver 110 receives the SCS from the timing controller 150. In response to the SCS, the scan driver 110 sequentially supplies first scan signals to the first scan lines S11 through S1*n*, and at the same time sequentially supplies second scan signals to the second scan lines S21 through S2*n*.

Figure 4:
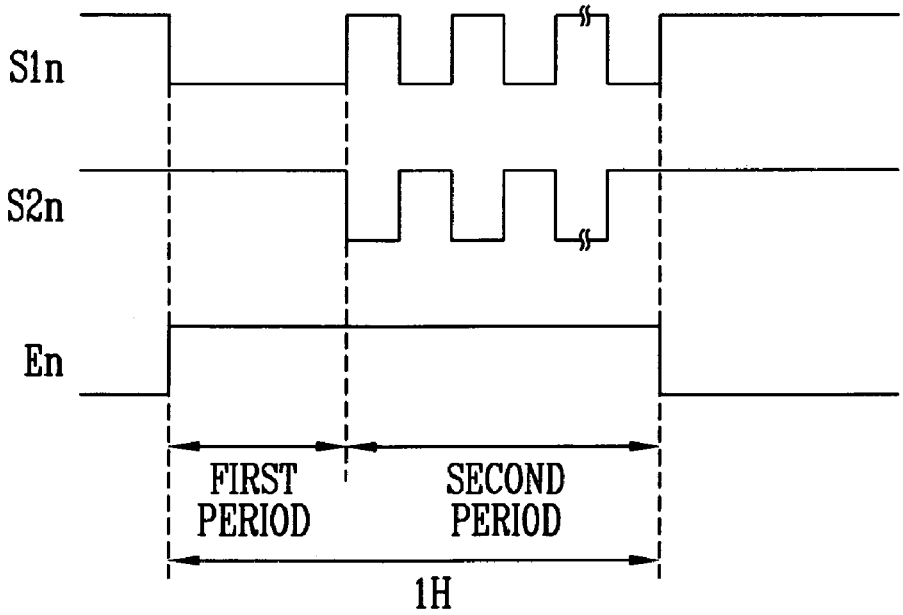
FIG. 4 is a view of waveforms of signals for driving the pixel of FIG. 3.

As shown in FIG. 4, the scan driver 110 supplies a first scan signal to turn on a first transistor M1 provided in the pixel 140 for a first period of one horizontal period, and to repeatedly turn on and off the first transistor M1 for a second period of one horizontal period. Furthermore, the scan driver 110 supplies a second scan signal to turn off a second transistor M2 provided in the pixel 140 for the first period of one horizontal period, and to repeatedly turn on and off the second transistor M2 alternately with the first transistor M1. The scan driver 110 also supplies an emission control signal to turn off a third transistor M3 provided in the pixel 140 for a predetermined horizontal period during which the first and second scan signals are supplied, and to turn on the third transistor M3 for the other period. According to an embodiment of the present invention, the emission control signal is supplied overlapping with the first and second scan signals, and has a width equal to or greater than that of the first scan signal.

The data driver 120 receives the DCS from the timing controller 150. Then, the data driver 120 generates the data signal in response to the DCS, and supplies the data signal to the data lines D1 through Dm. The data driver 120 supplies a predetermined gradation voltage as the data signal to the data lines D1 through Dm.

The data driver 120 receives a pixel current from the pixel 140 for a partial second period of one horizontal period, and checks whether the received pixel current has a level corresponding to the data Data. For example, when a pixel current flowing in the pixel 140 corresponding to a bit value (or gradation level) of the data Data is 10 μA, the data driver 120 checks whether the pixel current received from the pixel 140 is 10 μA. When the data driver 120 receives an undesired current from each pixel 140, the data driver 120 adjusts the gradation voltage, thereby allowing a desired current to flow in each pixel 140. The data driver 120 comprises at least one data driving circuit 129 having j channels (where, j is a natural number). A detailed configuration of the data driving circuit 129 is described later.

FIG. 3 is a circuit diagram of a pixel of FIG. 2. For the sake of convenience, FIG. 3 exemplarily illustrates a pixel that is connected to the mth data line Dm, the nth first scan line S1*n*, the nth second scan line S2*n*, and the nth emission control line En.

Referring to FIG. 3, the pixel 140 according to an embodiment of the present invention comprises a first transistor M1, a second transistor M2, a third transistor M3 and a driver 142.

The first transistor M1 is connected between the data line Dm and a driver 142, and supplies the gradation voltage from the data line Dm to the driver 142. The first transistor M1 is controlled by the first scan signal transmitted to the nth first scan line S1*n*.

The second transistor M2 is connected between a data line Dm and the driver 142, and supplies the pixel current from the driver 142 to the data line Dm. The second transistor M2 is controlled by the second scan signal transmitted to the nth second scan line S2*n*.

The third transistor M3 is connected between the driver 142 and a light emitting device OLED. The third transistor M3 is controlled by the emission control signal transmitted to the nth emission control line En. The emission control signal is supplied overlapping with the first and second scan signals respectively supplied to the nth first and second scan lines S1*n* and S2*n*. The third transistor M3 is turned off while the emission control signal is being supplied, and is turned on while the emission control signal is not being supplied.

The driver 142 supplies the pixel current to the second transistor M2 and the third transistor M3 in correspondence with the data signal received from the first transistor M1. The driver 142 comprises a fourth transistor M4 connected between the first voltage line ELVDD and the third transistor M3, and a capacitor C connected between a gate electrode of the fourth transistor M4 and the first voltage line ELVDD. Alternatively, the driver 142 is not limited to the configuration shown in FIG. 3, and can comprise various well-known circuits. Also, the transistors M1 through M4 shown in FIG. 3 are illustrated as P-channel Metal Oxide Semiconductor (PMOS) transistors. However, the present invention is not limited thereto.

Referring to FIGS. 3 and 4, the pixel 140 operates as follows.

For a predetermined horizontal period of one frame, the first scan signal is supplied through the nth first scan line S1*n*, and at the same time, the second scan signal is supplied through the nth second scan line S2*n*.

The first transistor M1 receives the first scan signal and is turned on from the first period of one horizontal period. As the first transistor M1 is turned on, the data signal of the data line Dm is supplied to the capacitor C for the first period. The capacitor C is charged with a predetermined voltage corresponding to the data signal. The second transistor M2 receives the second scan signal and is maintained turned off for the first period.

Then, the first transistor M1 is turned off and the second transistor M2 is turned on for a part of a second period. As the second transistor M2 is turned on, the pixel current is supplied from the fourth transistor M4 to the data line Dm in correspondence with a predetermined voltage charged in the capacitor C. Thus, the pixel current is supplied from the data line Dm to the data driver 120, and the data driver 120 increases or decreases the level of the gradation voltage in accordance with the pixel current, thereby allowing a desired pixel current to flow in the pixel 140.

Then, the second transistor M2 is turned off, and the first transistor M1 is turned on. As the first transistor M1 is turned on, the gradation voltage increased or decreased by the data driver 120 is supplied to the capacitor C, thereby controlling the level of the voltage charged in the capacitor C. The first transistor M1 and the second transistor M2 are alternately turned on and off at least once in the second period, so that the voltage charged in the capacitor C is controlled to allow the desired pixel current to flow in the pixel 140.

The emission control signal is supplied to the nth emission control line En for the predetermined horizontal period, so that the third transistor M3 is turned off. Therefore, the pixel current is not supplied to the light emitting device OLED. Then, the emission control signal is not supplied to the nth emission control line En after the passage of the predetermined horizontal period, so that the third transistor M3 is turned on and the pixel current is supplied to the light emitting device OLED. The pixel current is adjusted to a desired value for the predetermined horizontal period, so that the light emitting device OLED can emit light with a desired brightness.

Figure 5:
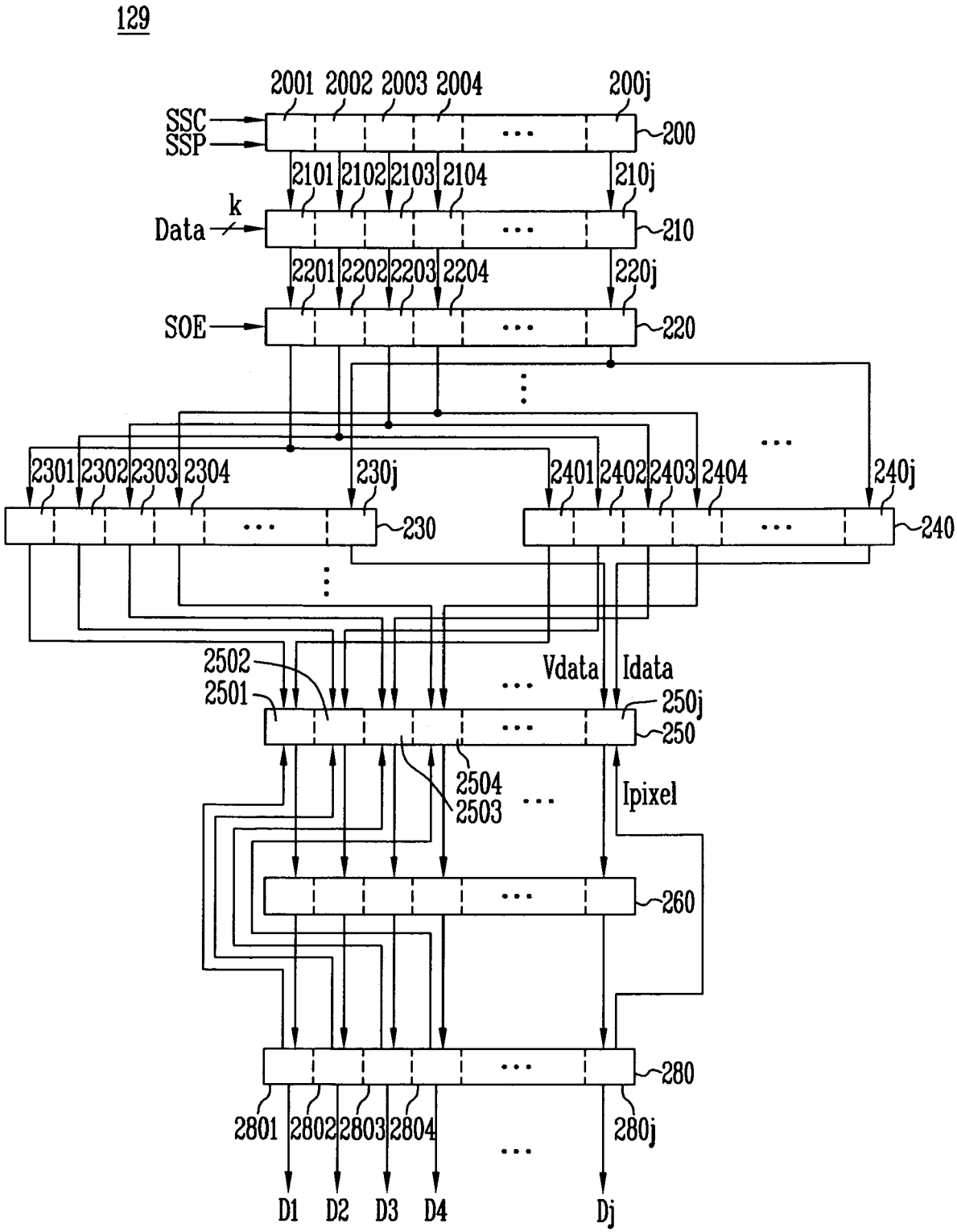
FIG. 5 is a block diagram of an embodiment of a data driving circuit of FIG. 2.

FIG. 5 is a block diagram of an embodiment of a data driving circuit of FIG. 2. For the sake of convenience, FIG. 5 exemplarily illustrates a pixel integrated circuit 129 having j channels.

Referring to FIG. 5, the data driving circuit 129 comprises a shift register 200 to generate sampling signals in sequence; a sampling latch 210 to store the data Data in sequence in response to the sampling signals; a holding latch 220 to temporarily store the data Data of the sampling latch 210 and supply the stored data Data to a voltage digital-analog converter (VDAC) 230 and a current digital-analog converter (IDAC) 240, the VDAC 230 to generate the gradation voltage Vdata corresponding to a gradation level of the data Data and the IDAC 240 to generate the gradation current Idata corresponding to the gradation level of the data Data; a voltage control unit 250 to control a gradation voltage Vdata in correspondence witnh the pixel current Ipixel supplied via the data lines D1 through Dj; a buffer unit 260 to supply the gradation voltage Vdata from the voltage control unit 250 to the data lines D1 through Dj; and a selection unit 280 to selectively connect the data lines D1 through Dj to either of the buffer unit 260 or the voltage control unit 250.

The shift register part 200 receives a source shift clock SSC and a source start pulse SSP from the timing controller 150 and shifts the source start pulse SSP per period of the source shift clock SSC, thereby generating j sampling signals in sequence. The shift register 200 comprises j shift registers 2001 through 200*j*.

The sampling latch 210 stores the data Data therein in sequence in response to the sampling signals sequentially supplied from the shift register 200. The sampling latch 210 comprises j sampling latches 2101 through 210*j* to store j data Data therein. Furthermore, the size of each sampling latches 2101 through 210*j* corresponds to a bit value of the data Data. For example, when the data Data is of k bits, each of the sampling latches 2101 through 210*j* has a size corresponding to k bits.

The holding latch 220 receives the data Data from the sampling latch 210 and stores it therein in response to a source output enable signal SOE. Furthermore, the holding latch 220 supplies the data Data stored therein to the VDAC 230 and the IDAC 240 in response to the source output enable signal SOE. The holding latch 220 comprises j holding latches 2201 through 220*j* each corresponding to k bits.

The VDAC 230 generates the gradation voltage Vdata corresponding to the bit value (i.e., gradation level) of the data Data, and supplies the gradation voltage Vdata to the voltage control unit 250. The VDAC 230 generates j gradation voltages Vdata corresponding to j data Data supplied from the holding latch 220. The VDAC 230 comprises j voltage generators 2301 through 230*j*. For the sake of convenience, the gradation voltage Vdata generated by the VDAC 230 will be called a first gradation voltage Vdata.

The IDAC 240 generates the gradation current Idata corresponding to the bit value of the data Data, and supplies the gradation current to the voltage control unit 250. The IDAC 240 generates j gradation currents Idata corresponding to j data Data supplied from the holding latch 220. The IDAC 240 comprises j current generators 2401 through 240*j*.

The current control unit 250 receives the first gradation voltage Vdata, the gradation current Idata and the pixel current Ipixel, and compares the gradation current Idata with the pixel current Ipixel, thereby controlling the level of the first gradation voltage Vdata on the basis of difference between the gradation current Idata and the pixel current Ipixel. Hereinafter, for the sake of convenience, the first gradation voltage Vdata controlled by the voltage control unit 250 will be called a second gradation voltage. Preferably, the voltage control unit 250 controls the level of the second gradation voltage to make the gradation current Idata equal to the pixel current Ipixel. The voltage control unit 250 comprises j voltage controllers 2501 through 250*j*.

The buffer unit 260 supplies the first gradation voltage Vdata or the second gradation voltage from the voltage control unit 250 to j data lines D1 through Dj. The buffer unit 260 comprises j buffers 2601 through 260*j*.

The selection unit 280 selectively connects the data lines D1 through Dj to either of the buffer unit 260 or the voltage control unit 250. The selection unit 260 comprises j selectors 2801 through 280*j*.

Figure 6:
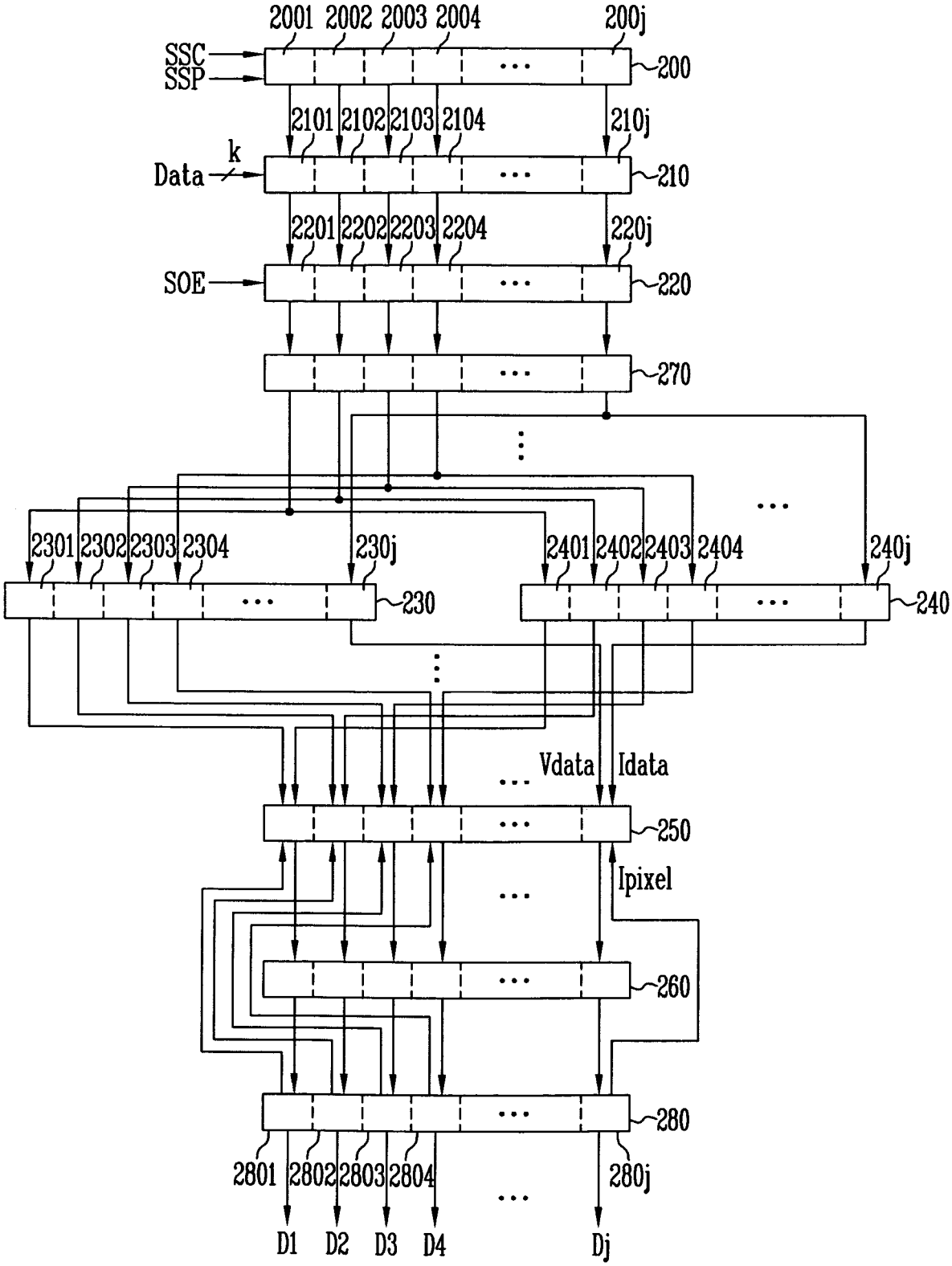
FIG. 6 is a block diagram of another embodiment of the data driving circuit of FIG. 2.

According to another embodiment of the present invention, the data driving circuit 129 further comprises a level shifter 270 between the holding latch part 220 and both the VDAC 230 and IDAC 240 as shown in FIG. 6. The level shifter part 270 increases the voltage level of the data Data supplied from the holding latch 220, and supplies it to the VDAC 230 and the IDAC 240. When the data Data having a high voltage level is supplied from an external system to the data driving circuit 129, circuit elements are needed for the high voltage level, so that production costs are increased. However, according to this embodiment of the present invention, even though the external system supplies the data Data having a low voltage level to the data driving circuit 129, the level shifter 270 increases the voltage level of the data Data into the high level, so that the circuit elements for the high voltage level are not additionally needed, thereby reducing the corresponding production costs. The level shifter 270 comprises j level shifters 2701 through 270*j*.

Figure 7:
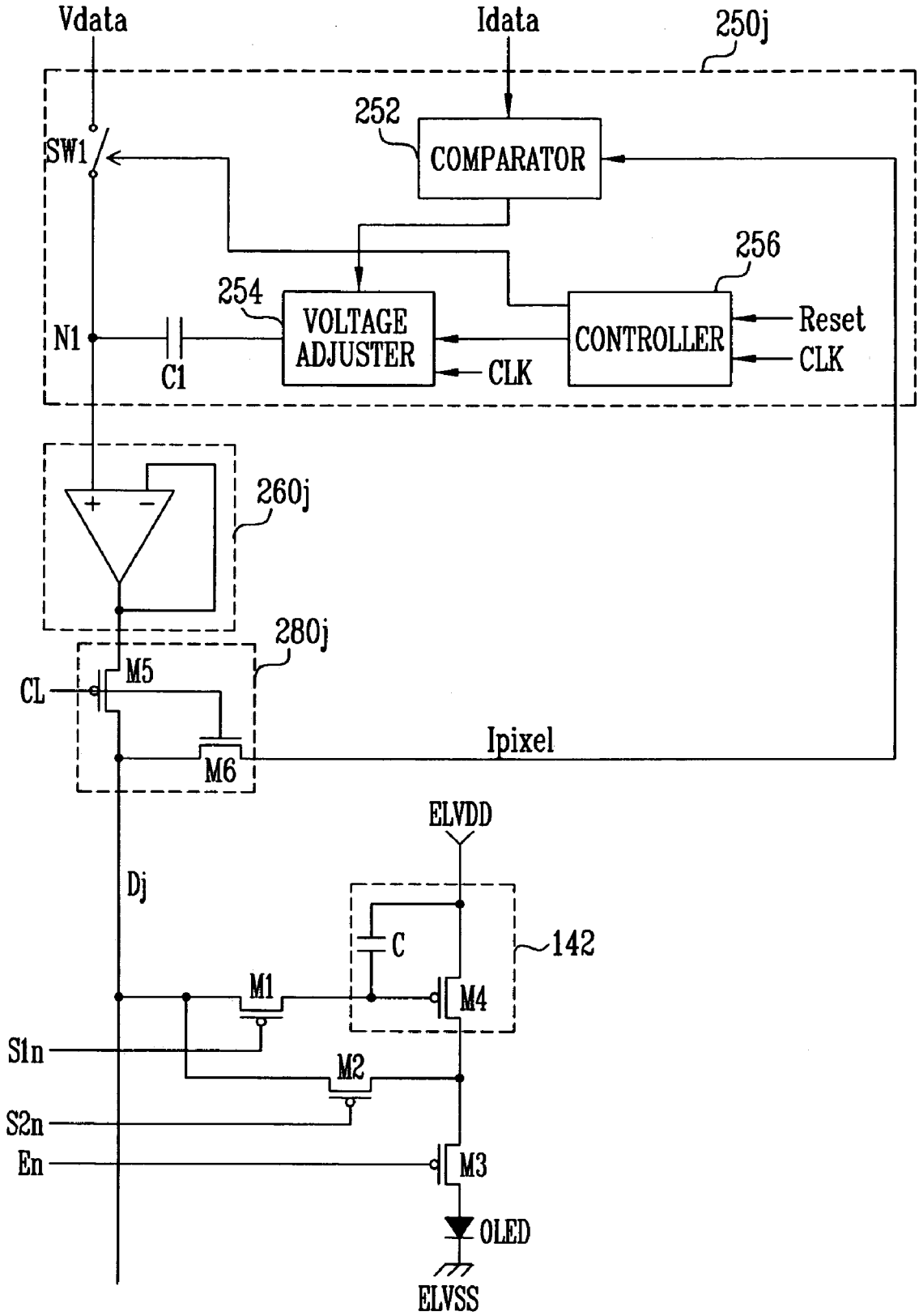
FIG. 7 is a circuit diagram including a voltage controller and a selector of FIGS. 3 and 4.

FIG. 7 is a circuit diagram including a voltage controller and a selector of FIG. 5. For the sake of convenience, FIG. 7 exemplarily illustrates the jth voltage controller 250*j* and the jth selector 280*j*.

Referring to FIG. 7, the selector 280*j* comprises a fifth transistor M5 connected between the buffer 260*j* and the data line Dj, and a sixth transistor M6 connected between the voltage controller 250*j* and the data line Dj. The fifth transistor M5 and the sixth transistor M6 are alternately turned on, and connect the data line Dj with either of the buffer 260*j* or the voltage controller 250*j*. For this, the fifth transistor M5 and the sixth transistor M6 are different conductive types. The fifth transistor M5 and the sixth transistor M6 are controlled by a selection signal supplied via a control line CL.

Figure 8:
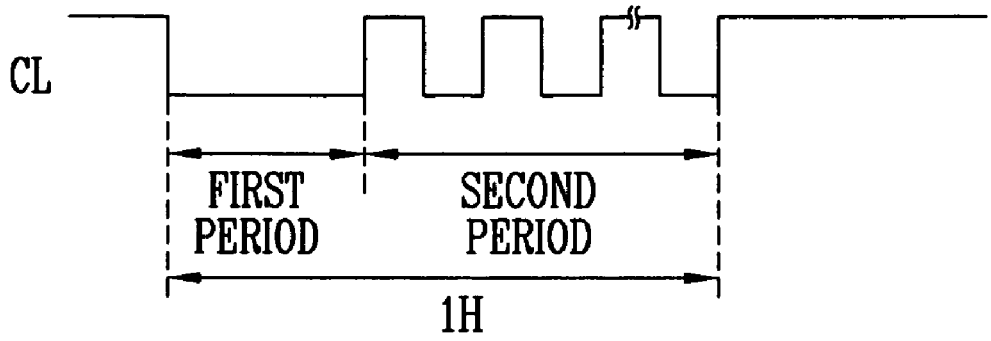
FIG. 8 is a view of a waveform of a selection signal supplied to the selector of FIG. 7.

As shown in FIG. 8, the selection signal is supplied for the first period of one horizontal period to turn on the fifth transistor M5. Furthermore, the selection signal is supplied to alternately turn on and off the fifth and sixth transistors M5 and M6 for the second period. For the second period, the selection signal is supplied to turn on and off the fifth transistor M5 in accordance with the first transistor M2, and to turn on and off the sixth transistor M6 in accordance with the second transistor M2.

The current controller 250*j* comprises a comparator 252, a voltage adjuster 254, a controller 256, a first capacitor C1, and a switching device SW1. The switching device SW1 is connected between the VDAC 230 and the buffer unit 260*j*. Furthermore, the switching device SW1 is controlled by the controller 256 to be turned on for the first period and tuned off for the second period.

The first capacitor C1 is connected between the voltage adjuster 254 and a first node N1 formed as a common node between the switching device SW1 and the buffer unit 260*j*. The first capacitor C1 connected between the first node N1 and the voltage adjuster 254 increases or decreases the level of voltage supplied to the first node N1 in correspondence with the voltage supplied from the voltage adjuster 254. For instance, when the voltage adjuster 254 supplies a high level voltage, the voltage supplied to the first node N1 is increased by the first capacitor C1. On the other hand, when the voltage adjuster 254 supplies a low level voltage, the voltage supplied to the first node N1 is decreased by the first capacitor C1.

The comparator 252 receives the gradation current Idata from the IDAC 240 and receives the pixel current Ipixel from the pixel 140 via the data line Dj and the selector 280*j*. The pixel current Ipixel is supplied from the pixel 140 that currently receives the first and second scan signals. Then, the comparator 242 receives the gradation current Idata and the pixel current Ipixel, and compares the gradation current Idata with the pixel current Ipixel, thereby supplying first and second control signals corresponding to the compared results to the voltage adjuster 254. For example, the comparator 252 generates the first control signal when the gradation current Idata is higher than the pixel current Ipixel. Furthermore, the comparator 242 generates a second control signal when the gradation current Idata is lower than the pixel current Ipixel.

The voltage adjuster 254 controls a predetermined voltage to the first capacitor C1 on the basis of the first and second control signal supplied from the comparator 252. The voltage adjuster 254 supplies the predetermined voltage to the first capacitor C1 so that the pixel current Ipixel is approximately equal to the gradation current Idata. Then, the voltage supplied to the first node N1 is increased or decreased corresponding to the voltage supplied to the first capacitor C1. The increased or decreased voltage of the first node N1 is used as the second gradation voltage.

The controller 256 turns on the switching device SW1 for the first period of one horizontal period 1H, and turns off the switching device SW1 for the second period. Furthermore, the controller 256 supplies a counting signal to the voltage adjuster 254, wherein the counting signal is gradually increased for the second period. For example, the controller 256 supplies the counting signal to the voltage adjuster 254, wherein the counting signal increases from "1" to "1" (where, "1" is a natural number). The controller 256 comprises a counter (not shown). The counting signal of the controller 256 is initialized in response to a reset signal. The reset signal is set to be supplied each horizontal period. For example, a horizontal synchronous signal H or a scan signal can be employed as the reset signal.

The voltage controller according to this embodiment of the present invention operates as follows. First, the switching device SW1, the fifth transistor M5, and the first transistor m1 are turned on for the first period of one horizontal period. When the switching device SW1 is turned on, the first gradation voltage Vdata is supplied from the VDAC 230 to the data line Dj via the buffer 260*j* and the fifth transistor M5. Then, the first gradation voltage Vdata is supplied from the data line Dj to the pixel 140 selected by the scan signal. That is, the first gradation voltage Vdata is supplied from the data line Dj to the driver 142 via the first transistor M1 turned on by the first scan signal. Then, the capacitor C of the driver 142 is charged with a voltage corresponding to the first gradation voltage Vdata. The first period is set to allow the capacitor C of the pixel 140 to be charged to a predetermined voltage corresponding to the first gradation voltage Vdata.

After the capacitor C of the pixel 140 is charged to the voltage corresponding to the first gradation voltage Vdata, at the beginning of the second period, the sixth and second transistors M6 and M2 are turned on, and the switching device SW1 and the fifth and first transistors M5 and M1 are turned off.

As the switching device SW1 is turned off, the first node is in a floating state. At this time, the voltage supplied to the first node is maintained as the first gradation voltage Vdata by a parasitic capacitor (not shown) or the like. Furthermore, the second transistor M2 is turned on, the pixel current Ipixel generated by the driver 142 of the pixel 140 is supplied to the comparator 252 via the second transistor M2, the data line Dj and the sixth transistor M6.

The comparator 252 receives the pixel current Ipixel and compares the pixel current Ipixel with the gradation current Idata supplied from the IDAC 240, thereby outputting the first and second control signals to the voltage adjuster 254 on the basis of the compared results. The gradation current Idata is an ideal current that should flow in the pixel 140 corresponding to the data Data, and the pixel current Ipixel is a real current that flows in the pixel 140.

For the second period, the controller 256 supplies the counting signal, which increases from "1" to "1", to the voltage adjuster 254. Then, the voltage adjuster 254 receives the counting signal and supplies a predetermined voltage corresponding to the first or second control signal of the comparator 252 to the first capacitor C1. The voltage adjuster 254 adjusts the voltage supplied to the first capacitor C1 on the basis of the first or second control signal so that the gradation current Idata and the pixel current Ipixel are approximately equal to each other. Then, the voltage supplied to the first node N1 varies corresponding to the voltage supplied to the first capacitor C1, thereby generating the second gradation voltage.

After the second gradation voltage has been generated, the sixth and second transistors M6 and M2 are turned off, and the fifth and first transistors M5 and M1 are turned on. When the fifth transistor M5 and the first transistor M1 are turned on, the second gradation voltage supplied to the first node N1 is supplied to the pixel 140. Then, the pixel 140 generates the pixel current Ipixel corresponding to the second gradation voltage. According to this embodiment of the present invention, the sixth and second transistors M2 and M6 are turned on and off alternately with the fifth and first transistors M1 and M5 at least one time for the second period, so that the gradation current Idata is similar or equal to the pixel current Ipixel.

Figure 9:
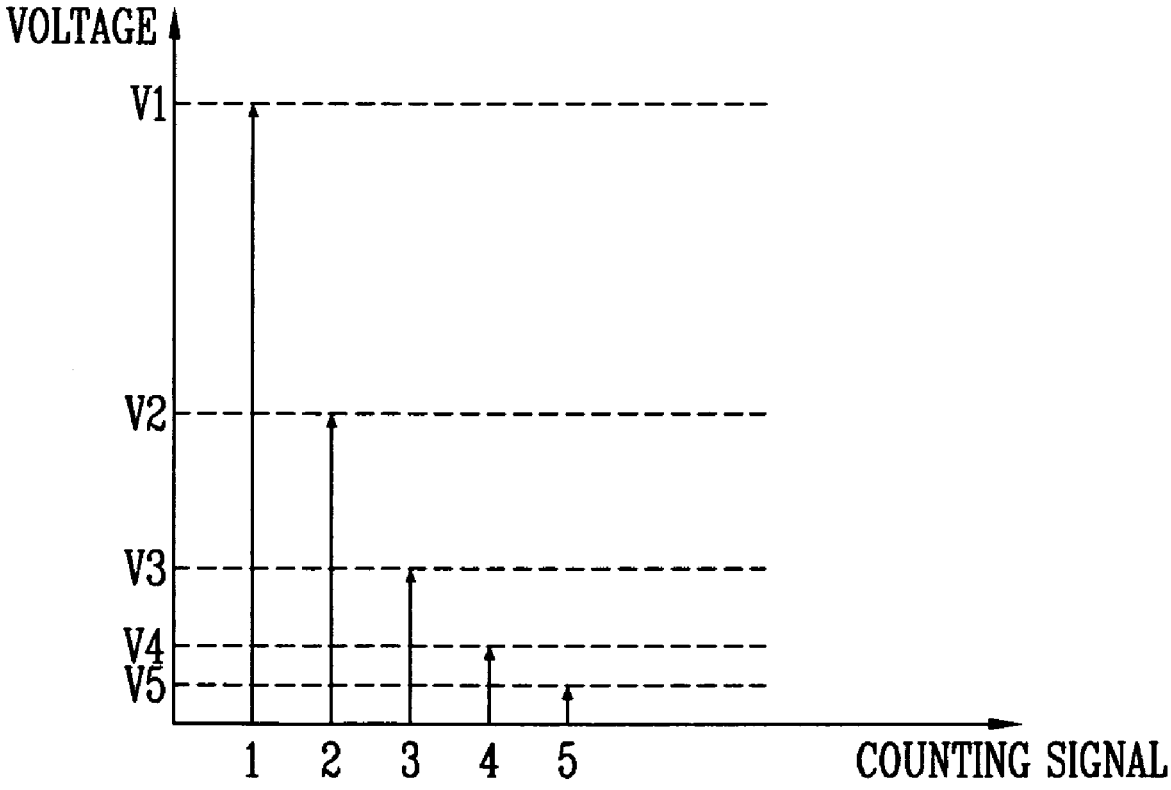
FIG. 9 is a graph to explain the operation of the voltage adjuster of FIG. 7.

An adjustable level of the voltage adjusted by the voltage adjuster 254 is determined by the counting signal. For example, when the voltage adjuster 254 receives the first counting signal (e.g., "1"), the voltage adjuster 254 adjusts the voltage to a first voltage (V1) as shown in FIG. 9. That is, when the first counting signal is supplied, the voltage is increased or decreased corresponding to a voltage of V1/2. Furthermore, when the voltage adjuster 254 receives the second counting signal (e.g., "2"), the voltage adjuster 254 adjusts the voltage to a second voltage V2 lower than the first voltage V1. That is, when the second counting signal is supplied, the voltage is increased or decreased corresponding to a voltage of V2/2. The second voltage V2 is set to about one half of the first voltage V1. Also, when the voltage adjuster 254 receives the third counting signal (e.g., "3"), the voltage adjuster 254 adjusts the voltage to a third voltage V3 lower than the second voltage V2. Thus, the more the counting signal increases, the more the adjustable level of the voltage adjusted by the voltage adjuster 254 decreases. The decreased voltage can be set to one half of the previous voltage. Likewise, the voltage adjuster 254 adjusts the voltage supplied to the first capacitor C1 so that the gradation current Idata and the gradation voltage Idata are similar or equal to each other.

Figure 10:
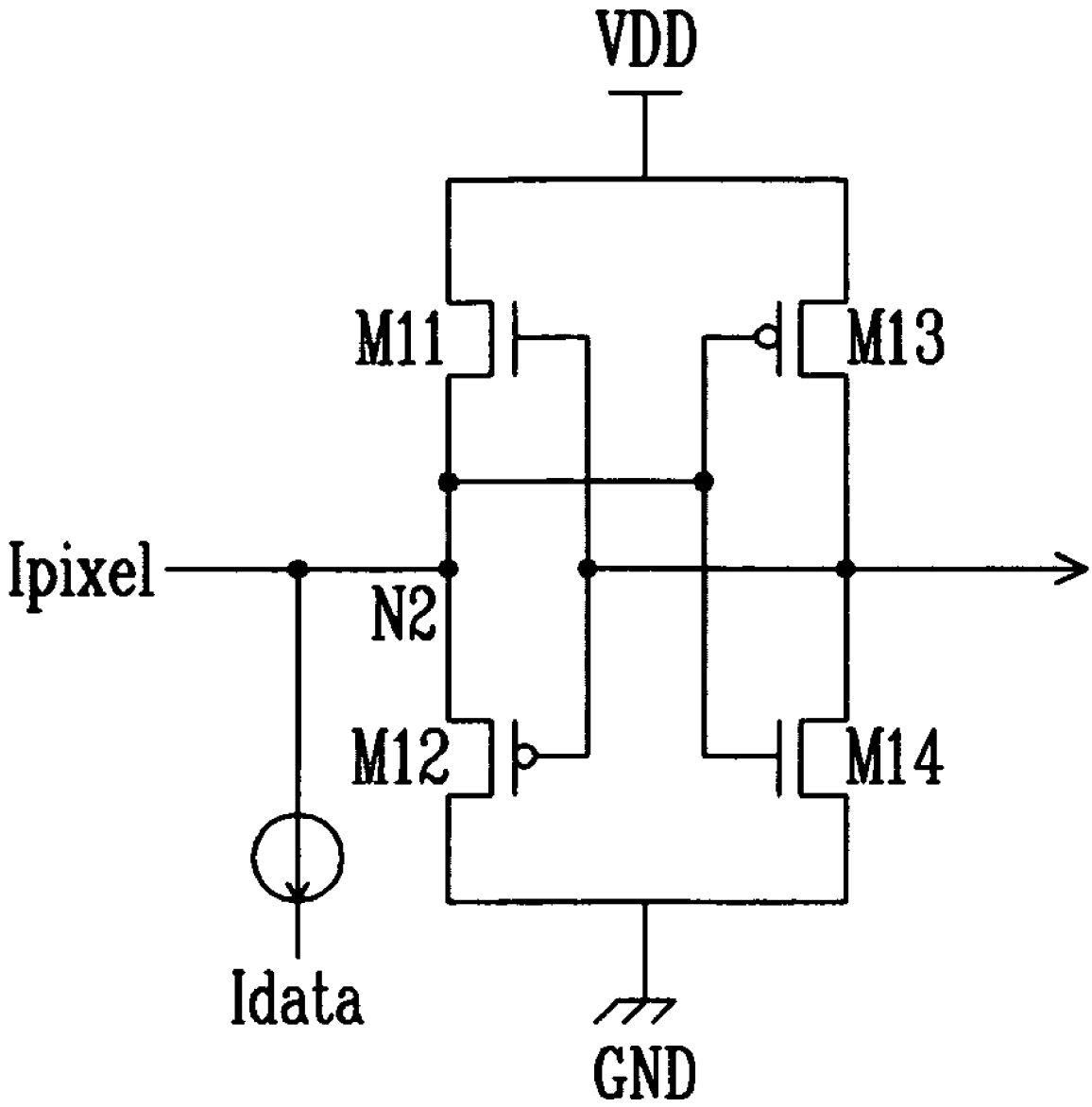
FIG. 10 is a detailed circuit diagram of the comparator of FIG. 7.

FIG. 10 is a detailed circuit diagram of the comparator of FIG. 7. The comparator of FIG. 10 was disclosed by the Institute of Electrical and Electronics Engineers (IEEE) in 1992. However, the comparator according to an embodiment of the present invention is not limited to that proposed by the IEEE. Alternatively, various well-known comparators can be used in the present invention as long as it can compare the currents.

Referring to FIG. 10, a current corresponding to difference between the pixel current Ipixel and the gradation current Idata is supplied to a second node N2. The current supplied to the second node N2 is supplied to gate terminals of third and fourth transistors M13 and M14 formed as an inverter. Then, either of the third transistor M13 or the fourth transistor M14 is turned on, thereby supplying a high voltage VDD or a low voltage GND to an output terminal. The voltage supplied to the output terminal is supplied to the gate terminals of first and second transistors M11 and M12, thereby stably maintaining the voltage supplied to the output terminal.

As described above, the present invention provides a data driving circuit to display an image with a desired brightness, an OELD display using the data driving circuit, and a method of driving the OELD display, in which a gradation current corresponding to data is compared with a pixel current flowing in a pixel, and a gradation voltage is controlled on the basis of the compared result so that the pixel current is approximately equal to the gradation current. According to an embodiment of the present invention, the pixel current is supplied from the pixel to the data driving circuit via a data line, and the gradation voltage is supplied from the data driving circuit to the pixel via the data line. Thus, the data line is shared in driving the OELD display according to an embodiment of the present invention, so that an additional line on a pixel portion is not needed, thereby improving an aperture ratio and simplifying the fabrication process.

Although exemplary embodiments of the present invention have been shown and described, it would be appreciated by those skilled in the art that modifications can be made to these embodiment without departing from the principles and spirit of the present invention, the scope of which is defined by the following claims.

What is claimed is:

1. A data driving circuit, comprising:

a voltage digital-analog converter adapted to generate a first gradation voltage corresponding to external data;

a current digital-analog converter adapted to generate a gradation current corresponding to the external data;

a voltage control unit adapted to receive a feedback pixel current from a pixel via a data line and to generate a second gradation voltage by increasing or decreasing a level of the first gradation voltage in accordance with the feedback pixel current;

a buffer unit adapted to selectively supply the first or second gradation voltage to the data line; and a selection unit adapted to selectively connect the data line to either the buffer unit or the voltage control unit.

2. The data driving circuit according to claim 1, wherein the selection unit is adapted to connect the data line to the buffer unit for a first period of one horizontal period, and is adapted to alternately connect the data line to either the buffer unit or the voltage control unit for a second period of one horizontal period excluding the first period.

3. The data driving circuit according to claim 2, wherein the selection unit comprises a plurality of selectors, each selector comprising:

a first transistor connected between the buffer unit and the data line; and a second transistor connected between the data line and the voltage control unit.

4. The data driving circuit according to claim 3, wherein the first transistor is adapted to be turned on for the first period, and the first and second transistors are adapted to be alternately turned on and off for the second period.

5. The data driving circuit according to claim 4, wherein the first gradation voltage is adapted to be supplied to the pixel for the first period, and the second gradation voltage is adapted to be supplied to the pixel upon the first transistor being turned on for the second period.

6. The data driving circuit according to claim 4, wherein the pixel current is adapted to be supplied from the data line to the voltage control unit upon the second transistor being turned on for the second period.

7. The data driving circuit according to claim 2, wherein the voltage control unit comprises a plurality of voltage controllers, each voltage controller comprising:

a switching device connected between the voltage digital-analog converter and the buffer unit;

a comparator adapted to compare the gradation current with the pixel current;

a capacitor having a first terminal connected to a common node between the switching device and the buffer unit;

a voltage adjuster connected to a second terminal of the capacitor and adapted to be controlled by the comparator to increase and decrease the voltage supplied to the second terminal of the capacitor; and a controller adapted to control the switching device.

8. The data driving circuit according to claim 7, wherein the controller is adapted to turn on the switching device for the first period, and to turn off the switching device for the second period.

9. The data driving circuit according to claim 7, wherein the comparator is adapted to generate a first control signal upon the gradation current being higher than the pixel current, and is adapted to generate a second control signal upon the gradation current being lower than the pixel current.

10. The data driving circuit according to claim 9, wherein the voltage adjuster is adapted to selectively increase or decrease the voltage supplied to the capacitor on the basis of the first and second control signals to equalize the pixel current with the gradation current.

11. The data driving circuit according to claim 10, wherein the controller is adapted to output a counting signal, gradually increased for the second period, to the voltage adjuster.

12. The data driving circuit according to claim 11, wherein an adjustable level of the voltage adjusted by the voltage adjuster is adapted to correspond to the counting signal.

13. The data driving circuit according to claim 12, wherein the adjustable level of the voltage adjusted by the voltage adjuster is adapted to decrease in proportion as the counting signal increases.

14. The data driving circuit according to claim 13, wherein the adjustable level of the voltage adjusted by the voltage adjuster is adapted to decrease by half whenever the counting signal increases.

15. The data driving circuit according to claim 11, wherein the controller is adapted to receive a reset signal each horizontal period and to initialize the counting signal.

16. The data driving circuit according to claim 15, wherein the reset signal includes either a horizontal synchronous signal or a scan signal supplied to the pixel each horizontal period.

17. The data driving circuit according to claim 1, further comprising:

a shift register adapted to generate sampling signals in sequence; and a latch adapted to store the data corresponding to the sampling signals, and to supply the stored data to the voltage digital-analog converter and the current digital-analog converter.

18. The data driving circuit according to claim 17, wherein the latch comprises:

a sampling latch adapted to sequentially store the data corresponding to the sampling signal;

a holding latch adapted to store the data stored in the sampling latch and to supply the stored data to the voltage digital-analog converter and the current digital-analog converter.

19. The data driving circuit according to claim 18, further comprising a level shifter adapted to increase a voltage of the data stored in the holding latch and to supply the increased data to the voltage digital-analog converter and the current digital-analog converter.

20. An Organic Light Emitting Diode (OLED) display, comprising:

a plurality of first and second scan lines;

a plurality of data lines intersecting the first and second scan lines;

a pixel portion including a plurality of pixels connected to the first and second scan lines and the data line;

a scan driver adapted to respectively supply first and second scan signals to the first and second scan lines; and a data driver connected to the data line and adapted to supply a first gradation voltage as a data signal to the data line;

wherein the data driver is adapted to receive a feedback pixel current from each pixel via the data line, to generate a second gradation voltage by selectively increasing or decreasing a level of the first gradation voltage in accordance with the feedback pixel current, and to supply the second gradation voltage to the pixel.

21. The OLED display according to claim 20, wherein each pixel comprises:

a light emitting device;

a driver adapted to generate the pixel current corresponding to either the first or second voltage;

a first transistor connected between the driver and the data line, and adapted to be controlled by a first scan signal supplied via the first scan line; and a second transistor connected between the data line and a common node between the driver and the light emitting device, and adapted to be controlled by a second scan signal supplied via the second scan line.

22. The OLED display according to claim 21, wherein the first transistor is adapted to be turned on in correspondence with the first scan signal for a first period of one horizontal period, and is adapted to be turned on and off at least one time for a second period of the horizontal period excluding the first period.

23. The OLED display according to claim 22, wherein the second transistor is adapted to be turned off in correspondence with the second scan signal for the first period, and is adapted to be turned on and off alternately with the first transistor for the second period.

24. The OLED display according to claim 23, wherein the data driver comprises at least one data driving circuit, the data driving circuit comprising:

a shift register adapted to generate sampling signals in sequence;

a latch adapted to store external data corresponding to the sampling signal;

a voltage digital-analog converter adapted to generate the first gradation voltage corresponding to the data stored in the latch;

a current digital-analog converter adapted to generate a gradation current corresponding to the data stored in the latch part;

a voltage control unit adapted to generate the second gradation voltage corresponding to the pixel current supplied through the data line;

a buffer unit adapted to selectively supply either the first gradation voltage or the second gradation voltage to the data line; and a selection unit adapted to selectively connect the data line to either the buffer unit or the voltage control unit.

25. The OLED display according to claim 24, wherein the selection unit is adapted to connect the data line to the buffer unit for the first period, and is adapted to alternately connect the data line between the buffer unit and the voltage control unit for the second period.

26. The OLED display according to claim 25, wherein the selection unit comprises a plurality of selectors, each selector comprising:

a third transistor connected between the buffer unit and the data line, and adapted to be turned on and off in accordance with the first transistor receiving the first scan signal; and a fourth transistor connected between the data line and the voltage control unit and adapted to be turned on and off in accordance with the second transistor receiving the second scan signal.

27. The OLED display according to claim 26, wherein the first gradation voltage or the second gradation voltage is adapted to be supplied from the buffer unit to the pixel via the data line upon the third transistor being turned on, and the pixel current is adapted to be supplied to the voltage control unit via the data line upon the fourth transistor being turned on.

28. The OLED display according to claim 25, wherein the voltage control unit comprises a plurality of voltage controllers, each voltage controller comprising:

a switching device connected between the voltage digital-analog converter and the buffer unit;

a comparator adapted to compare the gradation current with the pixel current;

a capacitor having a first terminal connected to a common node between the switching device and the buffer unit;

a voltage adjuster connected to a second terminal of the capacitor and adapted to be controlled by the comparator to selectively increase and decrease the voltage supplied to the second terminal of the capacitor; and a controller adapted to control the switching device.

29. The OLED display according to claim 28, wherein the controller is adapted to turn on the switching device for the first period, and is adapted to turn off the switching device for the second period.

30. The data driving circuit according to claim 28, wherein the voltage adjuster is adapted to selectively increase or decrease the voltage supplied to the capacitor on the basis of compared results of the comparator to equalize the pixel current with the gradation current.

31. The OLED display according to claim 30, wherein the controller is adapted to output a counting signal, gradually increased for the second period, to the voltage adjuster.

32. The OLED display according to claim 31, wherein the adjustable level of the voltage adjusted by the voltage adjuster is adapted to decrease in proportion as the counting signal increases.

33. The OLED display according to claim 32, wherein the adjustable level of the voltage adjusted by the voltage adjuster is adapted to decrease by half whenever the counting signal increases.

34. The OLED display according to claim 21, further comprising a third transistor connected between the driver and the light emitting device, and adapted to be turned off for a predetermined period upon the first scan signal being supplied to the first transistor and adapted to be turned on for the other period in correspondence with an emission control signal supplied via an emission control line.

35. A method of driving an Organic Light Emitting Diode (OLED) display, comprising:

generating a first gradation voltage and a gradation current corresponding to data;

supplying a first gradation voltage to the pixel via the data line;

generating a pixel current with the pixel corresponding to the first gradation voltage;

supplying the pixel current to the data driver via the data line; and comparing the gradation current with the pixel current with the data driver, and generating a second gradation voltage by increasing or decreasing a level of the first gradation voltage on the basis of the compared result.

36. The method according to claim 35, further comprising supplying the first gradation voltage to the pixel for a first period of one horizontal period.

37. The method according to claim 36, further comprising:

generating the second gradation voltage by increasing or decreasing the level of the first gradation voltage on the basis of the compared result to cause the pixel current be equal to the gradation current; and supplying the second gradation voltage to the pixel via the data line.

38. The method according to claim 37, further comprising repeating supplying the pixel current to the data driver via the data line; and comparing the gradation current with the pixel current with the data driver, and generating a second gradation voltage by increasing or decreasing a level of the first gradation voltage on the basis of the compared result at least one time for a second period of one horizontal period excluding the first period.

39. The method according to claim 38, further comprising:

generating a counting signal, gradually increased for the second period; and controlling an adjustable level of the first gradation voltage in accordance with the counting signal.

40. The method according to claim 39, further comprising decreasing the adjustable level of the first gradation voltage in proportion as the counting signal increases.

* * * * *

UNITED STATES PATENT AND TRADEMARK OFFICE

CERTIFICATE OF CORRECTION

PATENT NO. : 7,649,514 B2
APPLICATION NO. : 11/313784
DATED : January 19, 2010
INVENTOR(S) : Choi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1062 days.

Signed and Sealed this

Twenty-third Day of November, 2010

David J. Kappos

David J. Kappos
*Director of the United States Patent and Trademark Office*